US006096959A

United States Patent [19]

Davide

[11] Patent Number: 6,096,959

[45] Date of Patent: Aug. 1, 2000

[54] SYSTEM FOR BALANCING UPRIGHT PIANO KEY MECHANISMS

[75] Inventor: Cerrato Davide, Asti, Italy

[73] Assignee: Cerrato Pianoforti Di Cerrato Davide, Asti, Italy

[21] Appl. No.: 09/230,634

[22] PCT Filed: Sep. 15, 1997

[86] PCT No.: PCT/EP97/05043

§ 371 Date: Jan. 27, 1999

§ 102(e) Date: Jan. 27, 1999

[87] PCT Pub. No.: WO98/55989

PCT Pub. Date: Dec. 10, 1998

[30] Foreign Application Priority Data

Jun. 6, 1997 [IT] Italy ..... TO97A0493

[51] Int. Cl.[7] ..... G10C 3/12

[52] U.S. Cl. ..... 84/433; 84/438; 84/432

[58] Field of Search ..... 84/432, 433, 438

[56] References Cited

U.S. PATENT DOCUMENTS

| | | | |
|---|---|---|---|
| 1,510,663 | 10/1924 | Finnimore | 84/433 |
| 2,031,748 | 2/1936 | Victor | 84/433 |
| 5,585,582 | 12/1996 | Stanwood | 84/452 |
| 5,796,024 | 8/1998 | Stanwood | 84/433 |

FOREIGN PATENT DOCUMENTS

| | | |
|---|---|---|
| 60899/80 | 2/1982 | Australia . |
| 2495808 | 6/1982 | France . |
| 08001590 | 9/1996 | Japan . |

*Primary Examiner*—Stanley J. Witkowski
*Assistant Examiner*—Shih-yung Hsieh
*Attorney, Agent, or Firm*—Paul & Paul

[57] ABSTRACT

A system for balancing upright piano key mechanisms consists in weighting the key (1) in its front portion (at 11), opposite to the portion (5) where the key downweight is usually placed, and consequently in weighting (at 15), by means of a weight simulating the weight of the hammer, also the portion where the hammer (7) rests, the hammer in turn resting, through the wippen (9), on the rear portion of the key, so as to create a balance between the front portion and the rear portion of the key itself.

3 Claims, 2 Drawing Sheets

SYSTEM FOR BALANCING UPRIGHT PIANO KEY MECHANISMS

BACKGROUND

The invention relates to a system for balancing upright piano key mechanisms, which is adapted to make said mechanisms more closely resemble those of grand pianos as to respondence.

It is known that at present there is a great difference of performance between grand or horizontal pianos and upright pianos, particularly for an accomplished and demanding pianist.

This difference is due to the fact that in grand pianos the key is balanced with respect to the balance rail pin by the weight of the wippen and its related hammer on one part and by the weight of the balancing leads on the other part, whereby the pianist operates the keys solely with the force of his fingers, creating a respondence between keys and strings which cannot be found in upright pianos.

Upright pianos, even those with the most advanced mechanisms, such as the Renner ones or the like, do not allow said respondence, because the wippen acting on the key weighs very light on it, whereby the best solution adopted so far in order to enable the pianist to play has been to place a downweight, consisting of a lead counterweight, on a portion of the key close to the wippen. In this way the key has no balance of forces and, as a result of this, the pianist must overcome this counterweight with the touch of his fingers in order to act on the strings through the piano key actions.

In other words, there is no direct respondence between the touch of the pianist and the striking, whereby an accomplished and demanding pianist will hardly find satisfaction in playing an upright piano.

SUMMARY OF THE INVENTION

Object of the present invention is to overcome the shortcomings discussed above, by providing a balancing system for keys and key mechanisms of upright pianos, which equilibrates the balancing static forces, thus allowing a more direct respondence of the key mechanisms to the pianist's touch on the key.

The system object of the invention consists in weighting the key in its front portion, opposite to the portion where the key downweight is usually placed, and consequently in weighting, by means of a weight simulating the weight of the hammer, also the portion where the hammer rests, the hammer in turn resting, through the wippen, on the rear portion of the key, so as to create a balance between the front portion and the rear portion of the key.

As a result, the force exerted by the pianist's finger is employed entirely to operate the hammer, thus obtaining a respondence between touch on the key and striking of the string which is definitely more direct and prompt, like that of grand or horizontal pianos.

The system according to the invention is described in detail herein by referring in particular to the attached drawings, to be taken as a non-limiting example, wherein

DETAILED DESCRIPTION OF THE PREFERRED EMBODIMENT

Figure 1:
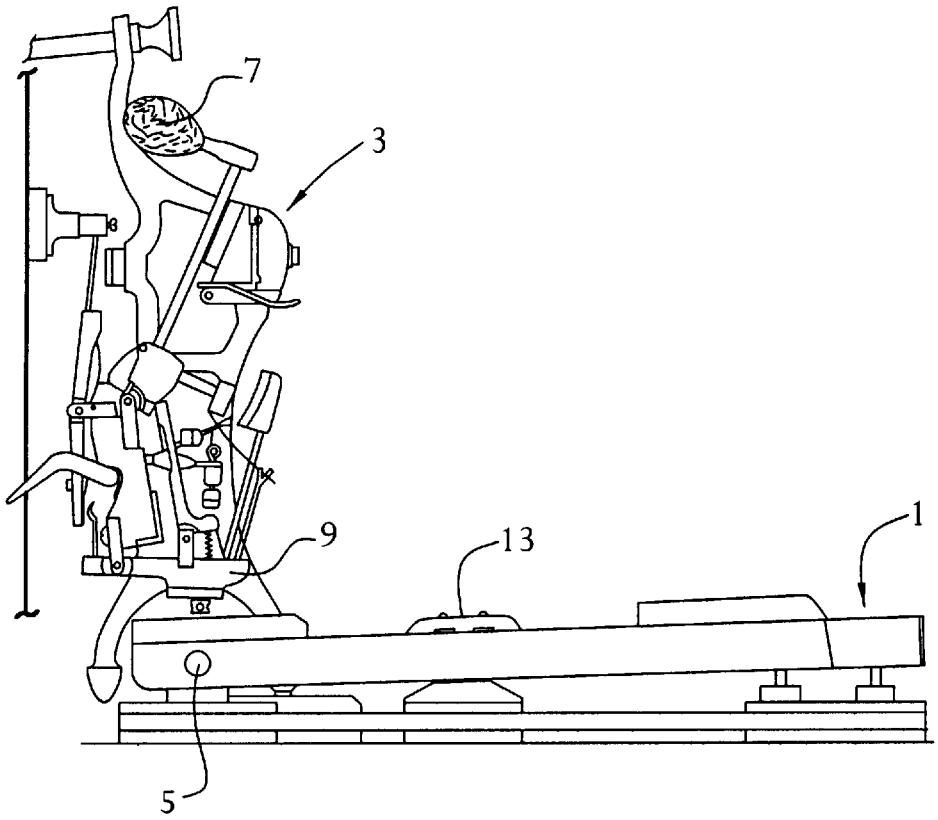
FIG. 1 schematically illustrates a side view of a prior art key mechanism.
Figure 2:
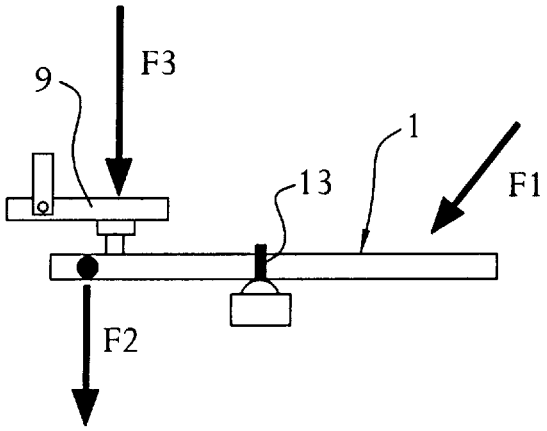
FIG. 2 is a schematic view of the forces balanced according to FIG. 1.

As shown in FIGS. 1 and 2, schematically illustrating a key and key mechanism according to the prior art, the key 1 acting on the key mechanism 3 has a downweight in 5 on the portion opposite to the one played by the pianist.

In the above solution the hammer 7 does not weigh directly on the wippen 9 and consequently on the key 1.

This feature results in the key 1 having difficulty in returning to its resting position, because the mechanism 3 does not provide much counterweight.

To overcome this shortcoming, piano manufacturers have so far placed the counterweight 5 on the key itself, by mounting a keylead 5 on that portion of the key 1 where the key mechanism 3 weighs.

In this way action is obtained by means of a key 1 weighted for its return stroke and a light key mechanism 3, where the pianist cannot feel the hammer 7 contacting the wippen 9 on return.

The shortcomings of an upright piano are therefore as follows:

balanced key mechanisms do not respond efficiently to the keyboard;

total lack of sensitivity, when touching the key, to the return of the hammer on the wippen.

Said sensitivity is typical of the grand piano and is what distinguishes the performance on such a piano from that on an upright piano.

FIG. 2 schematically shows the combined forces acting in an upright piano according to the prior art discussed above: F1 is the force exerted by the pianist, F2 is the force of the lead 5, and F3 is the weight of the wippen 9 on the key 1.

Taking into account the above remarks, the arrangement according to the invention tries to simulate the combination of forces existing in horizontal pianos, i.e. to obtain a balanced key which transmits the force of the pianist directly on the hammer and from the hammer to the strings.

Figure 3:
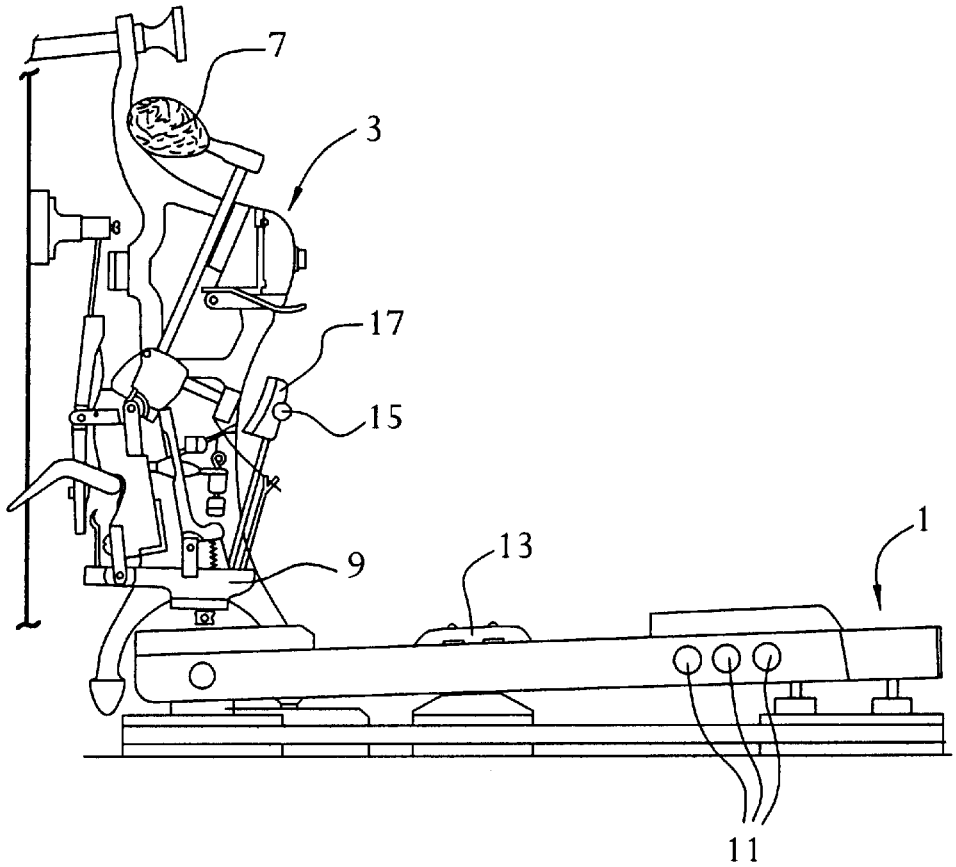
FIG. 3 schematically illustrates a key action with the key mechanisms modified in accordance with the invention.

FIG. 3 indicates the arrangement object of the invention, wherein the key 1 is weighted at 11 by means of appropriate keyleads on a portion which is the front one with respect to the fulcrum 13, and the wippen 9 weighted at 15 by means of an appropriate balancing weight, or weight simulating the weight of the hammer 7, rests on the said key.

In the described embodiment, said weight 15 on the wippen 9 is applied on the hammer back check 17, but obviously this does not limit the invention.

Figure 4:
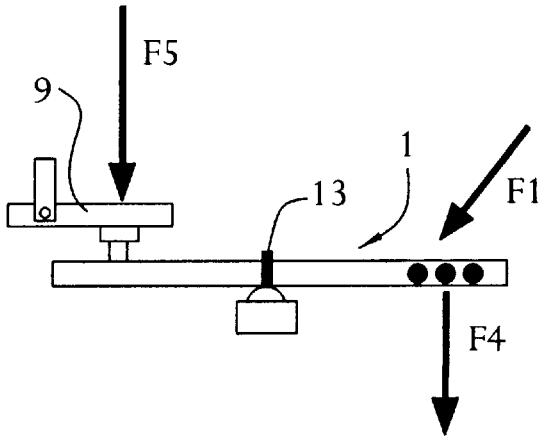
FIG. 4 is a schematic view of the forces balanced according to FIG. 3.

In this way, see FIG. 4, three forces are exerted on the key 1: the force F1, i.e. the force of the pianist, the force F4, i.e. the force exerted by the downweight placed at 11 on the front portion of the key 1, and the force F5, i.e. the force which the wippen 9 weighted at 15 exerts by weighing on the rear portion of the key 1.

It is evident that said modification to the balance of the forces acting on the key 1 and on the key mechanism 3 closely resembles the combination of forces existing in horizontal pianos, and this is of great advantage to those who, though having an upright piano, want a performance which, from the point of view of the sensitivity to the touch, is as good as the performance of a grand piano.

It is apparent that the invention is not limited to the embodiment described and disclosed, and that several variations and further improvements can be made without departing from the scope of the invention.

What is claimed is:

1. A system for balancing an upright piano key mechanism, said piano key mechanism having a key and a hammer, said key having a front portion and a rear portion, said rear portion being where key weighting is usually effected, said system comprising a weight simulating the weight of a hammer in a grand piano on the rear portion of the key to weight the rear portion of the key where the hammer rests, said hammer in turn resting, through the wippen, on the rear portion of the key to create a balance between the front portion and the rear portion of the key itself, whereby when a downweight is placed on the front portion of the key, a weight simulating the weight of a hammer in a grand piano is placed on the wippen.

2. The system for balancing said upright piano key mechanism of claim 1, wherein weighting of the wippen is effected by placing a balancing weight on the back check.

3. The system for balancing said upright piano key mechanism of any of claims 1 or 2, wherein the key has a fulcrum. and wherein downweight placed on the front portion of the key is obtained by means of a plurality of keyleads such that the key is balanced with respect to its fulcrum and a force exerted by a pianist on the key is transmitted with the same respondence as is found in grand pianos.

* * * * *